United States Patent [19]

Klett et al.

[11] 4,182,057

[45] Jan. 8, 1980

[54] RELEASABLE CORNER TOOTH ASSEMBLY

[75] Inventors: Gene R. Klett, Joliet; Jerome A. Thies, Geneseo, both of Ill.

[73] Assignee: Caterpillar Tractor Co., Peoria, Ill.

[21] Appl. No.: 916,456

[22] Filed: Jun. 16, 1978

[51] Int. Cl.[2] ..... E02F 9/28

[52] U.S. Cl. ..... 37/141 T

[58] Field of Search ..... 37/141 R, 141 T, 142 R, 37/142 A

[56] References Cited

U.S. PATENT DOCUMENTS

| | | | |
|---|---|---|---|
| 3,621,594 | 11/1971 | Hahn et al. | 37/141 R |
| 3,812,608 | 5/1974 | Ratkowski | 37/141 T |
| 4,007,550 | 2/1977 | Stepe | 37/141 T |
| 4,071,967 | 2/1978 | Klett | 37/141 T |

*Primary Examiner*—E. H. Eickholt

*Attorney, Agent, or Firm*—Charles E. Lanchantin, Jr.

[57] ABSTRACT

An earthmoving implement (10) has a sidewall member (12) and a cutting edge (14), and an adapter (26) is releasably secured thereto. The sidewall member (12) has a step (20), and the adapter (26) has a pair of outer and inner mounting portions (35, 36) defining a first slot (38) therebetween. The adapter (26) also has a bottom portion (40) connected to the outer mounting portion (35) and defining a second slot (42) with the inner mounting portion (36) so that the first slot (38) straddles the sidewall member (12) and the second slot (42) straddles the cutting edge (14). A projection (80) is defined on the adapter (26) forwardly of the first slot (38) for transmitting a portion of a working force on the adapter into the step (20), and a fastening device (28) releasably connects the adapter (26) to the implement (10) and transmits another portion of the working force into the sidewall member (12).

11 Claims, 4 Drawing Figures

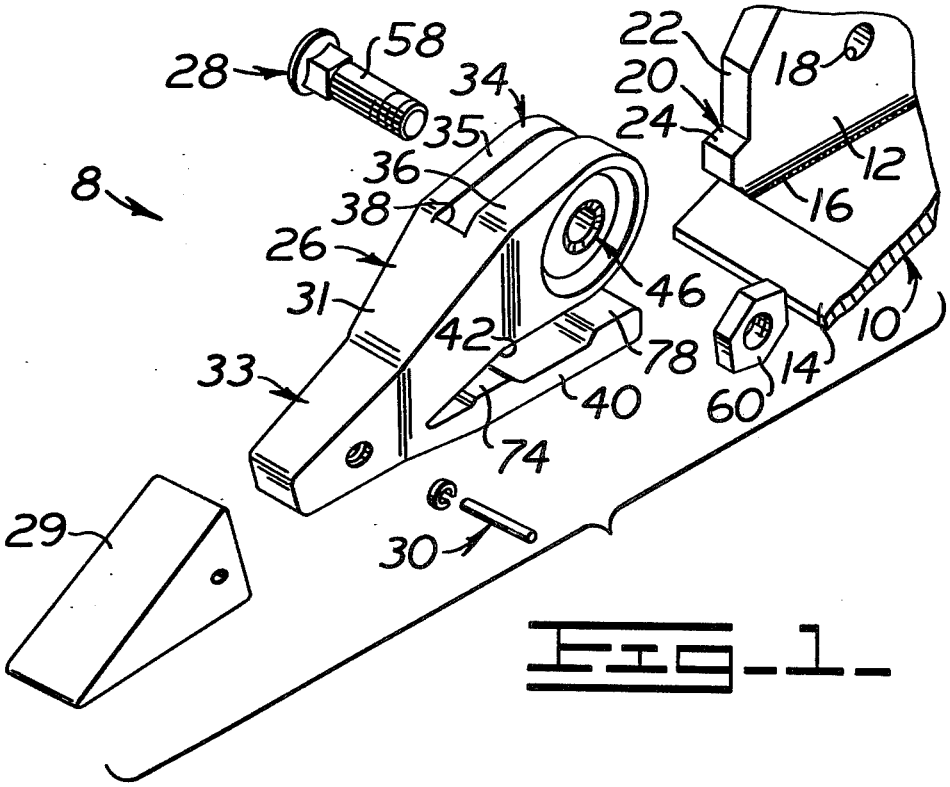
Fig-1-
Fig-2-
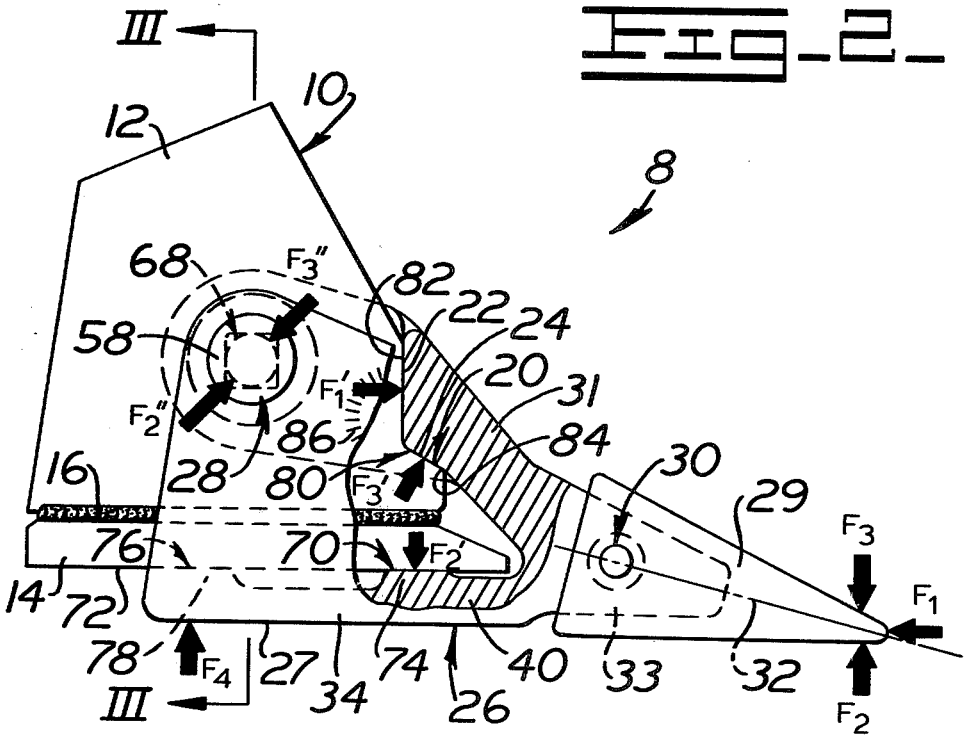

RELEASABLE CORNER TOOTH ASSEMBLY

TECHNICAL FIELD

The present invention is related to an earth-moving implement, and more particularly to a releasable corner tooth assembly therefor.

BACKGROUND ART

Each corner of a work implement, such as a loader bucket, often has a hardened earthworking adapter and tip assembly thereat in order to in order to increase the work capabilities of the implement and to also prolong the service life of the implement at the corners. As can be expected, relatively large working forces are generated upon the releasable tip, and the adapter conventionally transmits these forces rearwardly into the sidewall member and the cutting edge. Exemplifying the art in this area are the following patents: U.S. Pat. No. 3,621,594 issued Nov. 23, 1971 to F. C. Hahn, et al; U.S. Pat. No. 3,812,608 issued May 28, 1974 to T. A. Ratkowski; U.S. Pat. No. 4,007,550 issued Feb. 15, 1977 to V. A. Stepe; and U.S. Pat. No. 4,071,967 issued Feb. 7, 1978 to R. Klett; the latter two patents being assigned to the assignee of the instant invention. Such tip supporting adapters are usually releasably secured to the implement by one or more bolts, and in order to relieve the shearing forces on the bolts it has been heretofore deemed necessary in many cases to provide shear blocks or the like integrated into the corner constructions of the implement. These shear blocks, shown for example in the forementioned U.S. Pat. No. 4,071,967, require additional costly manufacturing steps and are in the way when the earthworking adapters and tips are not needed on the implement.

Another problem that has been experienced with such constructions is that downward working forces of relatively high magnitude on the adapter and the tip are often transmitted directly upon the cutting edge. This has resulted in shortening the desired service life of the cutting edge.

Frequently, in order to minimize some of the aforementioned problems, the construction of the adapter and associated retaining devices becomes so complex so that not only is the cost undesirably high, but also the service time required for field replacement is excessive.

The present invention is directed to overcoming one or more of the problems as set forth above.

DISCLOSURE OF INVENTION

In accordance with one aspect of the present invention, the releasable corner tooth assembly includes an implement having a sidewall member, a step defined in the sidewall member, and a cutting edge connected to the sidewall member. The assembly further includes an adapter having a pair of inner and outer mounting portions defining a first slot therebetween, a bottom portion connected to the outer mounting portion and defining a second slot with the inner mounting portion. With this construction the first slot straddles the sidewall member and the second slot straddles the cutting edge. Advantageously, a projection defined on the adapter transmits a portion of a working force on the adapter into the step of the sidewall member, and a fastening device releasably connects the adapter to the implement and transmits another portion of the working force into the sidewall member.

In another aspect of the invention, the adapter has an elongate body having a forward nose portion and a rear leg portion. A pair of laterally spaced outer and inner mounting portions are formed on the leg portion and define a first slot. A bottom portion formed on the leg portion extends laterally inwardly to define a second slot with the inner mounting portion. The adapter further defines a pair of laterally aligned openings in the outer and inner mounting portions, and a projection having first and second connected surfaces is located forwardly of the first slot.

BRIEF DESCRIPTION OF DRAWINGS

FIG. 1 is an exploded and diagrammatic isometric view of a releasable corner tooth assembly constructed in accordance with an embodiment of the present invention, including a fragmentary inside portion of a front corner of a loader bucket.

FIG. 2 is a diagrammatic, side elevational view of the corner tooth assembly shown in FIG. 1, with portions broken open and sectioned in order to better illustrate details of construction thereof.

BEST MODE FOR CARRYING OUT THE INVENTION

Figure 3:
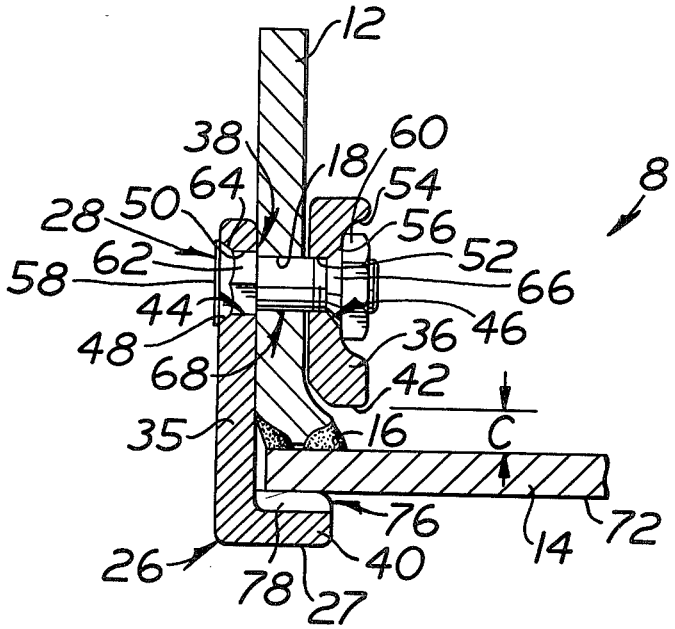
FIG. 3 is a diagrammatic, vertical cross sectional view through the corner tooth assembly as taken along line III—III of FIG. 2.

FIG. 1 illustrates a corner tooth assembly 8 constructed in accordance with the present invention and including a portion of one of the front corners of an earthmoving implement such as a loader bucket 10 having a normal forward longitudinal direction of working movement. The implement has an upright sidewall member 12 and a horizontally disposed cutting edge 14 connected to the lower edge of the sidewall as by inner and outer weld joints 16. Advantageously, the sidewall member 12 has a fastener-receiving cylindrical opening 18 laterally therethrough and a forwardly and upwardly facing step 20. Preferably, the step 20 has a substantially upright or vertical face 22 and an intersecting, forwardly descending or inclined face 24.

In general, the corner tooth assembly 8 includes an adapter 26 having a flat bottom skid surface 27, fastener means or a fastening device 28 for releasably connecting the adapter to the implement 10, and a conventional hardened earth penetrating tip 29 which is releasably connected to the adapter by a standard pin assembly 30.

More specifically, as shown in FIGS. 1 and 2, the adapter 26 has an elongate body 31 having a longitudinal axis 32 that is inclined or that descends in the forward direction relative to the bottom surface 27. A forward nose portion 33 and a rear leg portion 34 are formed integrally with the body. A pair of laterally spaced outer and inner mounting portions 35, 36 are formed on the rear leg portion and define a first slot 38 between them as is shown best in FIG. 4. A bottom portion 40 is integrally connected to the bottom of the outer mounting portion 35 and extends laterally inwardly to define a second slot 42 with the inner mounting portion 36 as shown best in FIG. 3. In this way it is clear that the first slot 38 relatively closely straddles the sidewall member 12, for example having only about 1 mm clearance, and the second slot 42 relatively loosely straddles the cutting edge 14.

Figure 4:
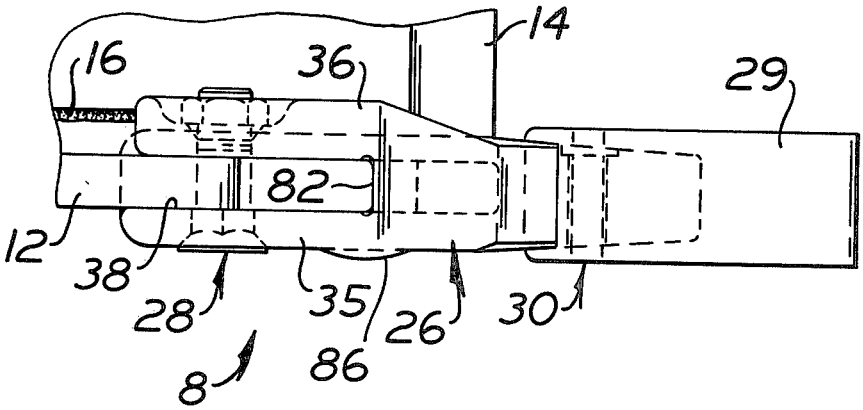
FIG. 4 is a diagrammatic, top plan view of the corner tooth assembly illustrated in FIGS. 1–3.

Referring to FIG. 3, the adapter 26 has first and second laterally aligned openings 44 and 46 through the outer and inner mounting portions 35,36 respectively for receiving the fastener means 28. The first opening 44 includes an outer annular conical surface 48 that connects with an inner surface 50 of polygonal cross section, and the second opening 46 includes an inner cylindrical bore 52, an outer enlarged counterbore 54, and an intermediate annular conical surface 56 therebetween. Preferably, the fastener means 28 includes a single plow bolt 58 which extends laterally inwardly through the openings 44, 18 and 46, and a nut 60 is screw threadably installed on the inner end thereof. A polygonal portion 62 of the bolt is advantageously received in the corresponding polygonal inner surface 50 to prevent rotation of the bolt during assembly or disassembly of the nut 60 and the adapter 26 to the implement 10. Moreover, conically tapered portions 64,66 on the bolt and nut respectively contact the surfaces 48,56 to permit relatively positive anchoring of first force transmitting means or a cylindrical bearing surface 68 of the bolt on the outer and inner mounting portions 35,36 of the adapter. In this regard, the diametral clearance between the bearing surface 68 and the opening 18 is relatively tight, for example, 1.6 mm.

As shown in FIGS. 2 and 3, the adapter 26 has second force transmitting means 70 for transferring certain external working forces upwardly into a bottom surface 72 of the cutting edge 14. Preferably, the second force transmitting means includes an upstanding bearing surface or pad 74 formed on the upper inside part of the bottom portion 40 of the adapter. As shown in FIG. 2, a third force transmitting means 76 is preferably provided for transferring certain external working forces upwardly into the bottom surface of the cutting edge at a spaced location rearwardly of the second force transmitting means 70. The third force transmitting means 76 preferably includes an upstanding bearing surface or pad 78 spaced rearwardly from the bearing pad 74.

In accordance with a major aspect of the invention, the corner tooth assembly 8 includes a fourth force transmitting means or projection means 80 for transmitting certain working forces on the adapter 26 primarily into the step 20 of the sidewall member 12. As shown best in FIG. 2, the projection means 80 preferably includes a substantially upright or vertical surface 82 and an intersecting, forwardly descending inclined surface 84, which surfaces are located generally forwardly of the first slot 38 or at the base of the first slot in the adapter. Thus, in use, the surface 82 is contiguous with the corresponding face 22 of the step, and the surface 84 is contiguous with the corresponding face 24 of the step. Moreover, as shown best in FIGS. 2 and 4, an embossment 86 extends integrally outwardly from the side of the adapter to provide increased sectional strength of the outer mounting portion 35 at the base of the first slot 38.

INDUSTRIAL APPLICABILITY

Horizontal rearward forces $F_1$ imposed on the tip 29 from the usual earthmoving operations, as shown in FIG. 2, are transmitted to the adapter 26 and primarily directly against the sidewall member 12 of the implement 10 by the fourth force transmitting means 80. Particularly, as depicted by reaction force arrow $F_1'$, such forces are transmitted substantially fully by the abutment of upright surface 82 against the upright face 22. However, some relatively minor degree of force transmitting reaction can also be experienced by the first force transmitting means 68 at the bolt 58.

Upwardly directly forces $F_2$ imposed on the tip 30 and tending to rotate the adapter 26 in a counterclockwise direction when viewing FIG. 2 are transmitted from the adapter 26 to the implement 10 primarily by the second force transmitting means 70, and secondarily to a relatively limited degree by the first force transmitting means 68. Specifically, as depicted by the respective reaction force indicating arrows $F_2'$ and $F_2''$, such forces are transmitted primarily by the bearing pad 74 into the bottom 72 of the cutting edge 14, and secondarily by the reaction of the bolt 58 against the sidewall member 12. In this regard, it is to be appreciated that the central bearing surface 68 of the bolt is relatively closely received in the opening 18 in the sidewall member 12 to better transmit such reaction forces into the implement.

Furthermore, downwardly directed forces $F_3$ imposed on the tip 30 and tending to rotate the adapter in a clockwise direction when viewing FIG. 2 are transmitted from the adapter 26 to the implement 10 primarily by the fourth force transmitting means 80, and secondarily by the first force transmitting means 68. More particularly, as depicted by the reaction force indicating arrows $F_3'$ and $F_3''$, such forces are transmitted primarily by the abutment of the inclined surface 84 with the inclined face 24 and secondarily by the reaction of the bolt 58 against the sidewall member 12. It is of major importance to note that downward forces upon the adapter are not transmitted to the cutting edge 14 so that its service life is significantly extended. Reference is made, for example, to the vertical clearance provided between the cutting edge 14 and the inner mounting portion 36 as designated by the identifying letter C in FIG. 3 which prevents the transmission of such undesirable loading.

The third force transmitting means 76 can be useful, for example, should upward forces $F_4$ be experienced at the rear of the adapter 26. In that case, the bearing pad 78 can abut the bottom surface 72 of the cutting edge 14 to simultaneously share the reaction of the first force transmitting means 68 against the sidewall member 12 and the second force transmitting means 70 against the bottom surface of the cutting edge. Hence, the third force transmitting means 76 can serve to protect the bolt 58 from undesirably high loads.

While in the instant example a separate tip 29 is releasably connected to the adapter 26 by the quick-release pin assembly 30, we contemplate that the nose portion 33 can be enlarged to provide an integral, forwardly extending hardened tip on the adapter for earth penetrating purposes without departing from the spirit of the present invention.

Other aspects, objects and advantages will become apparent from a study of the specification, drawings and appended claims.

What is claimed is:

1. In a releasable corner tooth assembly (8) of the type including an implement (10) and an adapter (26); the implement (10) having a normal forward longitudinal direction of working movement, an upright sidewall member (12) and a laterally disposed cutting edge (14) connected to the sidewall member (12); the adapter (26) having a pair of laterally spaced outer and inner mounting portions (35,36) defining a first slot (38) therebetween, a bottom portion (40) connected to the outer mounting portion (35) and defining a second slot (42)

with the inner mounting portion (36), the first slot (38) straddling the sidewall member (12) and the second slot (42) straddling the cutting edge (14); the improvement comprising:

step means (20) defined in said sidewall member (12);

projection means (80) for transmitting a portion of an external working force on said adapter (26) into said step means (20) of the sidewall member (12); and first means (28) for releasably connecting said adapter (26) to said implement (10) and transmitting another portion of said external working force into said sidewall member (12).

2. The corner tooth assembly (8) of claim 1 wherein said step means (20) includes an upright face (22) and a connecting forwardly depending inclined face (24).

3. The corner tooth assembly (8) of claim 1 wherein said projection means (80) includes an upright surface (82) and a connecting forwardly depending inclined surface (84).

4. The corner tooth assembly (8) of claim 1 wherein said first means (28) includes a bolt (58) extending through said outer and inner mounting portions (35,36) and said sidewall member (12).

5. The corner tooth assembly (8) of claim 1 including a second means (70) for transmitting upward forces on said adapter (26) to said cutting edge (14), said second means (70) being defined on said adapter (26).

6. The corner tooth assembly (8) of claim 5 wherein said second means (70) includes an upstanding bearing pad (74) on said bottom portion (40) of said adapter (26).

7. The corner tooth assembly (8) of claim 6 including a second upstanding bearing pad (78) on said bottom portion (40), said second bearing pad (78) being spaced longitudinally rearwardly of said first bearing pad (74).

8. In a releasable corner tooth assembly (8) of the type including an implement (10) and an adapter (26); the implement (10) having a normal forward longitudinal direction of working movement, an upright sidewall member (12) and a laterally disposed cutting edge (14) connected to the sidewall member (12); the adapter (26) having a pair of laterally spaced outer and inner mounting portions (35,36) defining a first slot (38) therebetween, a bottom portion (40) connected to the outer mounting portion (35) and defining a second slot (42) with the inner mounting portion (36), the first slot (38) straddling the sidewall member (12) and the second slot (42) straddling the cutting edge (14); the improvement comprising:

a forwardly and upwardly facing step (20) defined in said sidewall member (12);

a rearwardly and downwardly facing projection (80) defined on said adapter (26) having a construction sufficient for transmitting a primary portion of a downward working force on said adapter (26) into said step (20); and a fastening device (28) releasably connecting said adapter (26) to said implement (10) and transmitting a lesser proportion of said downward working force than said primary portion into said sidewall member (12).

9. The corner tooth assembly (8) of claim 8 wherein said projection (80) includes an upright surface (82) and a forwardly depending inclined surface (84), both of said surfaces (82,84) being located generally forwardly of said first slot (38).

10. The corner tooth assembly (8) of claim 9 including laterally aligned opening means (18,44,46) defined in said outer and inner mounting portions (35,36) and in said sidewall member (12), said fastening device (28) including a screwthreadably releasable fastener extending through said opening means.

11. The corner tooth assembly (8) of claim 8 including a raised bearing pad (74) on said bottom portion (40) of said adapter (26), said bearing pad (74) being of a construction sufficient for transferring forces upwardly against said cutting edge (14).

* * * * *